United States Patent [19]

Hansen

[11] 4,138,172

[45] Feb. 6, 1979

[54] HANGING CARD STORAGE SYSTEM

[76] Inventor: Robert S. Hansen, 2 E St., Santa Rosa, Calif. 95404

[21] Appl. No.: 861,979

[22] Filed: Dec. 19, 1977

[51] Int. Cl.[2] ..... A47B 63/00; B42F 15/00; B42F 17/02; B42F 17/08

[52] U.S. Cl. ..... 312/184; 40/380; 220/22.1

[58] Field of Search ..... 312/183, 184, 193; 220/22.1, 22.5, 22.2; 40/380

[56] References Cited

FOREIGN PATENT DOCUMENTS

| | | | |
|---|---|---|---|
| 41881 | 11/1909 | Austria | 220/22.5 |
| 1026351 | 4/1953 | France | 312/184 |
| 1507180 | 12/1967 | France | 220/22.1 |
| 525890 | 5/1968 | France | 220/22.1 |

*Primary Examiner*—Mervin Stein
*Assistant Examiner*—Alex Grosz
*Attorney, Agent, or Firm*—Flehr, Hohbach, Test, Albritton & Herbert

[57] ABSTRACT

Card storage system in which cards such as file cards are suspended in a box, tray or other receptacle by means of laterally extending shoulders on the cards. The shoulders incline inwardly and downwardly from the upper portions of the lateral edges of the cards and tend to keep the cards centered laterally as well as upright in the receptacle. The system can be utilized with existing receptacles as well as new ones.

10 Claims, 4 Drawing Figures

HANGING CARD STORAGE SYSTEM

BACKGROUND OF THE INVENTION

This invention pertains generally to file cards and receptacles therefore and more particularly to a card storage system in which the cards are suspended in an upright position.

Cards such as common 3 × 5 inch file cards, magnetic cards, and other computer related cards are commonly stacked on edge in receptacles such as boxes, trays, drawers and other containers. In such receptacles, the cards have a tendency to fall over unless a certain minimum number of cards are present. When one or more of the cards are removed, the remaining cards tend to fall together, making it difficult to find the location from which the cards were removed and to replace the cards.

SUMMARY AND OBJECTS OF THE INVENTION

The invention provides a system in which cards are suspended by laterally extending shoulders and cannot fall over in the receptacles. The shoulders incline inwardly and downwardly from the upper portions of the lateral edges of the cards and tend to keep the cards centered laterally as well as upright. The system can be added to existing receptacles as well as being incorporated in new ones.

It is in general an object of the invention to provide a new and improved card storage system.

Another object of the invention is to provide a system of the above character in which the cards are suspended in an upright position and cannot fall over.

Another object of the invention is to provide a system of the above character which can be utilized both with existing card receptacles and with new ones.

Additional objects and features will be apparent from the following description in which the preferred embodiments are set forth in detail in conjunction with the accompanying drawings.

DESCRIPTION OF THE PERFERRED EMBODIMENTS

Figure 1:
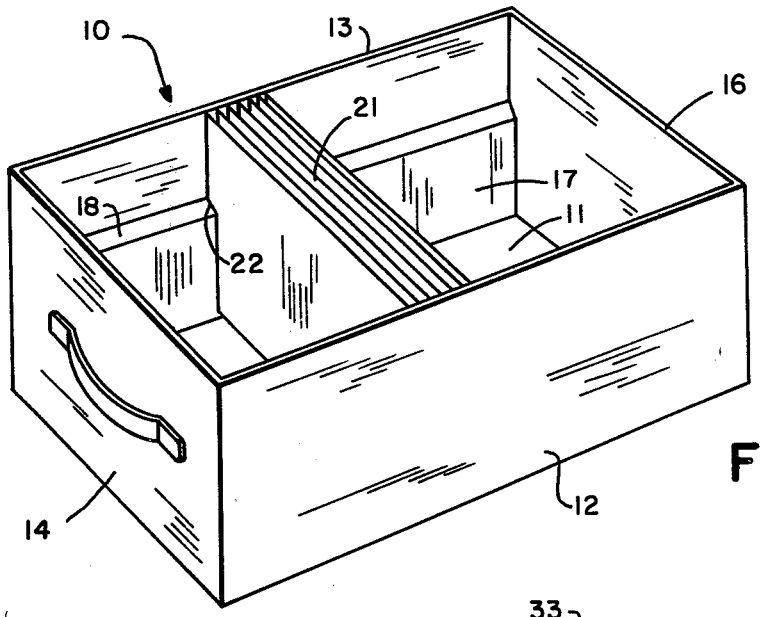
FIG. 1 is a perspective view of one embodiment of a file card system incorporating the invention.

In FIG. 1, the invention is illustrated in connection with a generally rectangular tray or drawer 10 having a bottom wall 11, generally parallel side walls 12, 13 and end walls 14, 16. Support rails 17 extend longitudinally of the tray adjacent to side walls 12, 13. The upper surfaces of the support rails are inclined downwardly and inwardly to form upwardly facing shoulders 18 from which the file cards are supported. As illustrated, these shoulders are spaced below the side walls of the tray, and they can be formed either as an integral part of the side walls or as a removable structure which can be utilized with existing trays.

A plurality of generally rectangular file cards 21 are mounted in tray 10 and suspended in an upright position. Toward their lateral edges, the cards are provided with downwardly facing shoulders 22 which rest upon the upwardly facing shoulders of rails 17. Shoulders 22 incline downwardly and inwardly from the upper portions of the side edges of the cards and are preferably located above the center line or center of gravity of the cards. In the preferred embodiment, shoulders 22 are formed by cutting away the lower portions of the lateral margins of the cards.

In operation and use, the file cards are placed in the tray with shoulders 22 resting upon shoulders 18. The cards are thereby suspended in an upright position with the lower edges of the cards spaced above the bottom wall of the tray. As long as the tray remains relatively level and the cards are reasonably well aligned in the lateral direction, the cards will remain in place and will not fall over even when only a few cards are present. At the same time, the cards can be readily shifted in the longitudinal direction or removed from the tray. In addition to holding the cards in an upright position, the inclined shoulders tend to keep the cards laterally centered.

Figure 2:
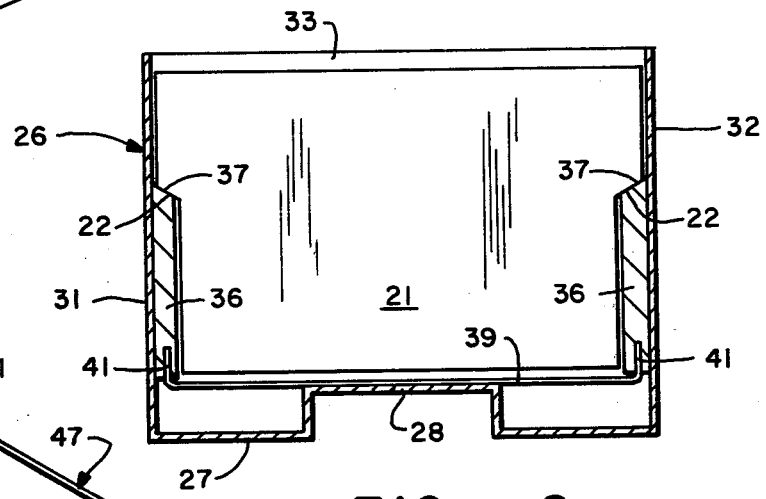
FIG. 2 is a cross sectional view of another embodiment of a file card system incorporating the invention.

In FIG. 2, the invention is illustrated in connection with a tray 26 which is typical of one type of tray heretofore provided for file cards. The bottom wall 27 of this tray has a raised central portion 28 in which longitudinally spaced slots (not shown) are formed to receive paddles or other supports for holding the cards in an upright postion. This tray also has upstanding side walls 31, 32 and end walls 33.

A removable support is mounted in tray 26 for suspending a plurality of cards 21 in the manner of the invention. This support includes longitudinally extending rail members 36 which are generally similar to rail members 17 of FIG. 1. These rail members include upwardly facing inclined shoulders 37 which receive the downwardly facing shoulders 22 of the cards.

A plurality of longitudinally spaced rods 39 extend between rail members 36, 36 and rest upon the upper surface of the raised portion of the bottom wall. The end portions of the rods are bent up and received in openings 41 in the lower portions of the rail members. This support can be readily assembled and disassembled and can be stored or packaged in a generally flat condition.

Operation and use of the embodiment of FIG. 2 is generally similar to that of FIG. 1. When the support is placed in tray 26, rods 39 rests on raised bottom wall portion 28 and hold the rail members in postion adjacent to side walls 31, 32. The inclined shoulders 22 of the cards rest upon inclined shoulders 37 to suspend the cards in an upright position with the lower edges of the cards spaced above raised portion 28 and rods 39.

Figure 3:
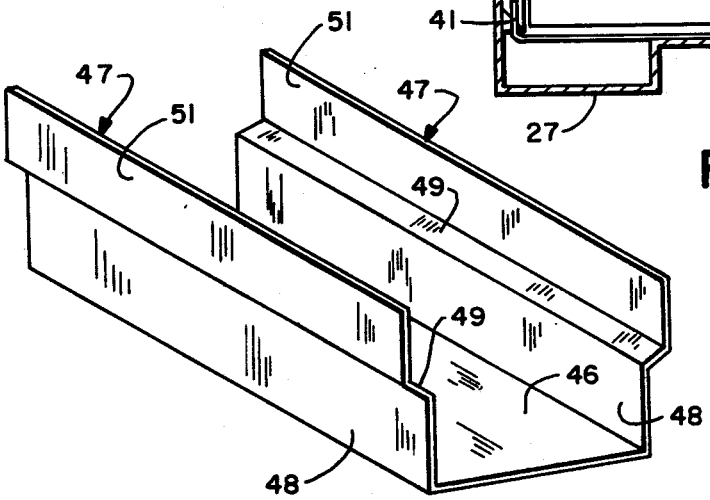
FIG. 3 is a perspective view of a supporting frame for use in the file card system of the invention.

FIG. 3 illustrates another support which can be utilized with existing receptacles for file cards. This support includes a generally planar bottom wall 46 and upstanding side walls 47. Each of the side walls includes a generally vertical lower portion 48, a central portion 49 which inclines upwardly and outwardly from the lower portion, and an upper portion 51 which extends vertically from central portion 49. The upper surfaces of central portions 49 form inwardly and downwardly inclined shoulders for receiving shoulders 22 of cards 21. The support of FIG. 3 is readily fabricated as a unitary structure of a suitable material such as sheet metal or plastic. It is particularly suitable for fabrication by an extrusion process, and it can be utilized without a tray or other receptacle, if desired.

Figure 4:
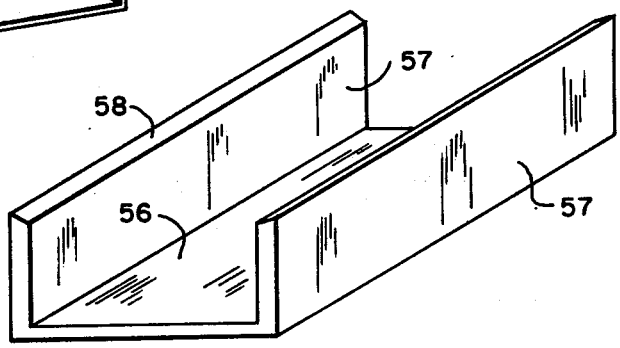
FIG. 4 is a perspective view of another embodiment of a supporting frame for use in the file card system of the invention.

FIG. 4 shows another support which can be utilized either by itself or in connection with a tray or other receptacle for file cards. This support includes a generally planar bottom wall 56 and rail members 57 which are generally similar to rail members 17, 36. The upper surfaces of these rail members are inclined inwardly and downwardly to form shoulders 58 for receiving the downwardly facing shoulders 22 of file cards 21. This embodiment is also particularly suited for fabrication by an extrusion process.

It is apparent that a new an improved card storage system has been provided. While only certain presently preferred embodiments have been described, as will be apparent familiar with the art, certain changes and modifications can be made with departing from the scope of the invention as defined by the following claims.

What is claimed is:

1. In a card storage system: a receptacle having a pair of spaced apart generally parallel side walls, downwardly and inwardly inclined upwardly facing surfaces extending longitudinally of the side walls, and a plurality of cards having downwardly and inwardly inclined lateral edge portions engaging the inclined surfaces above the centers of gravity of the cards, the relative vertical dimensions of the receptacle and cards being such that the cards are suspended freely from the upwardly facing surfaces in an upright position with the lower edge portions of the cards spaced above the bottom wall of the receptacle.

2. The card system of claim 1 wherein the inclined surfaces are formed on longitudinally extending rails adjacent to the side walls.

3. The card system of claim 2 wherein the rails are removably mounted in the receptacle.

4. The card system of claim 3 including a laterally extending member interconnecting the lower portions of the rails and positioned below the lower edges of the cards.

5. The card system of claim 4 wherein the rails and the laterally extending member are formed as a unitary structure.

6. In a card storage system comprising a receptacle having a pair of spaced apart generally parallel side walls and a plurality of generally rectangular cards having downwardly facing shoulders at the lateral edges and above the centers of gravity thereof, said shoulders being downwardly and inwardly inclined, the improvement comprising: upwardly facing shoulders inclined downwardly and inwardly, extending longitudinally of the side walls above the horizontal center lines of the walls for supporting engagement with the downwardly facing shoulders of the cards, the relative vertical dimensions of the receptacle and cards being such that the cards hang in an upright position in the receptacle and are supported only by the shoulders with no contact between the cards and receptacle below the shoulders.

7. The card system of claim 6 wherein the longitudinally extending shoulders are formed on removable rails adjacent to the side walls.

8. In a card storage system comprising a generally rectangular receptacle and a plurality of generally rectangular cards having downwardly facing shoulders at the lateral edges and above the centers of gravity thereof, said shoulders being downwardly and inwardly inclined: a pair of rail members having upwardly facing shoulders, inclined downwardly and inwardly, for engaging the downwardly facing shoulders of the cards to suspend the cards in an upright position, and means for maintaining the rail members in spaced apart relationship adjacent to opposing side walls of the receptacle with the upwardly facing shoulders spaced between the upper and lower edges of the side walls, the relative vertical dimensions of the receptacle and cards being such that the cards hang freely in the receptacle and are supported only by the shoulders with no contact between the cards and the rail members or receptacle below the shoulders.

9. The card system of claim 8 wherein the rail members and the means for maintaining the rail members in spaced relationship are formed as a unitary structure.

10. The card system of claim 8 wherein the means for maintaining the rail members in spaced relationship extends laterally between the lower portions of the rail members and is adapted to rest on a support toward the bottom of the receptacle.

* * * * *